US009238307B2

(12) United States Patent
Wirz

(10) Patent No.: US 9,238,307 B2
(45) Date of Patent: Jan. 19, 2016

(54) FIBERBOARD AND METHODS FOR MAKING SAME

(75) Inventor: Joseph H. Wirz, Duluth, MN (US)

(73) Assignee: Georgia-Pacific Wood Products LLC, Atlanta, GA (US)

( * ) Notice: Subject to any disclaimer, the term of this patent is extended or adjusted under 35 U.S.C. 154(b) by 572 days.

(21) Appl. No.: 12/835,826

(22) Filed: Jul. 14, 2010

(65) Prior Publication Data

US 2011/0014425 A1 Jan. 20, 2011

Related U.S. Application Data

(60) Provisional application No. 61/225,326, filed on Jul. 14, 2009.

(51) Int. Cl.
*B27N 3/00* (2006.01)

(52) U.S. Cl.
CPC ..... *B27N 3/00* (2013.01); *Y10T 428/24355* (2015.01); *Y10T 428/31971* (2015.04)

(58) Field of Classification Search
CPC ..... B27N 3/00; Y10T 428/24355; Y10T 428/31971; Y10T 428/24364; Y10T 428/24372; Y10T 428/2438; Y10T 428/24388; Y10T 428/24405; Y10T 428/24413; Y10T 428/24421; Y10T 428/2443; Y10T 428/24438
USPC ..... 428/532, 141–150
See application file for complete search history.

(56) References Cited

U.S. PATENT DOCUMENTS

| | | | | |
|---|---|---|---|---|
| 5,624,616 | A * | 4/1997 | Brooks | 264/83 |
| 7,399,350 | B2 * | 7/2008 | Rajaraman et al. | 106/31.59 |
| 2003/0134554 | A1 * | 7/2003 | Halm et al. | 442/123 |
| 2005/0011621 | A1 * | 1/2005 | Westermark et al. | 162/9 |
| 2006/0047062 | A1 * | 3/2006 | Hsu et al. | 524/556 |
| 2006/0141264 | A1 * | 6/2006 | Rearick | 428/423.1 |
| 2008/0105392 | A1 * | 5/2008 | Duggirala et al. | 162/23 |
| 2008/0187668 | A1 * | 8/2008 | Auger | 427/333 |
| 2009/0163619 | A1 * | 6/2009 | Hsu et al. | 523/335 |
| 2010/0068390 | A1 * | 3/2010 | Auger | 427/301 |

* cited by examiner

*Primary Examiner* — Nathan Van Sell
(74) *Attorney, Agent, or Firm* — Ram W. Sabnis

(57) ABSTRACT

Fiberboards and methods for making the same. The fiberboard can include two or more compressed fibers; less than 10 wt % of resin and wax, based on total weight of the fibers; and a coating comprising at least one colorant, wherein the colorant covers at least 70% of the fiberboard surface.

29 Claims, No Drawings

FIBERBOARD AND METHODS FOR MAKING SAME

CROSS-REFERENCE TO RELATED APPLICATIONS

This application claims the benefit of U.S. Provisional Application Ser. No. 61/225,326, filed Jul. 14, 2009, which is incorporated herein by reference in its entirety.

BACKGROUND OF THE INVENTION

1. Field of the Invention

Embodiments of the present invention generally relate to wet processed fiberboard and methods for making same. More particularly, embodiments of the present invention relate to wet processed fiberboard having improved moisture absorption and breakdown properties and methods for making same.

2. Description of the Related Art

Fiberboards, such as hardboards, medium density fiberboards ("MDF"), and low density fiberboards ("LDF") are typically made using a wet process, a dry process, or a wet/dry process. Additives, including resins and waxes, are introduced to a slurry of fibers, which is pressed and dried to make a fiberboards. The additives improve the structural integrity, hardness, and durability of the fiberboards, but are environmentally unfriendly. Typical resins include urea-formaldehyde and phenol-formaldehyde, among other resins and typical waxes are hydrocarbon based.

While currently available fiberboards exhibit relatively good hardness, rigidity, and durability properties, such fiberboards with resins and waxes are resistant to moisture absorption and breakdown, which is undesirable for some applications. For example, fiberboards used as bedding for animals require moisture absorption and must be discarded or recycled after a period of use. The resins and waxes make recycling an inefficient and difficult process by inhibiting the fiberboards ability to decompose.

There is a need, therefore, for improved wet processed fiberboards having improved moisture absorption and/or breakdown properties and methods for making same.

SUMMARY OF THE INVENTION

Fiberboards and methods for making the same are provided. In at least one specific embodiment, the fiberboard includes two or more compressed fibers; less than 10 wt % of resin and wax, based on total weight of the fibers; and a coating comprising at least one colorant, wherein the colorant covers at least 70% of the fiberboard surface.

In at least one specific embodiment, the method for making the fiberboard includes mixing a fiber material and water to provide a slurry, wherein the slurry is substantially free of added resin and wax. The slurry can be deposited onto a first liquid-pervious support member. A first portion of the water can be removed from the slurry to provide a fiber mat. The fiber mat can be pressed between a smooth surface and a second liquid-pervious support member to remove a second portion of the water from the fiber mat to provide a fiberboard having a first side and a second side. The first side of the fiberboard can be smoother than the second side. The fiberboard can be dried. A coating can be applied at least partially about the first side, the second side, or both, wherein the coating comprises a surfactant.

In at least one other specific embodiment, the fiberboard includes compressed fibers, wherein the fibers are substantially free of added resin and wax. The fiberboard can further include a coating disposed about at least a portion thereof, wherein the coating comprises from about 0.01 wt % to about 0.03 wt % decyl alcohol ethoxylate, based on the total weight of the fiberboard and at least one colorant.

In at least one other specific embodiment, the fiberboard includes compressed fibers that are substantially free of added resin and wax. The fiberboard can further include a coating disposed about at least a portion of the fiberboard, wherein the coating comprises a surfactant and at least one colorant.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

The fiberboard can include one or more compressed fibers. The fiberboard can include up to 99 wt % fibers, based on the total weight of the fiberboard. In one or more embodiments, the fiberboard includes up to 98 wt %, 97 wt %, 96 wt %, 95 wt %, 90 wt %, 85 wt %, 80 wt %, 75 wt %, 70 wt %, 65 wt %, 60 wt %, 55 wt %, 50 wt %, 40 wt %, 35 wt %, or 30 wt %, fibers based on the total weight of the fiberboard. In one or more embodiments, the fiberboard includes at least 50 wt %, 55 wt %, 60 wt %, 65 wt %, 70 wt %, 75 wt %, 80 wt %, 85 wt %, 88 wt %, 90 wt %, 92 wt %, 93 wt %, 94 wt %, 95 wt %, 96 wt %, 97 wt %, or 98 wt %, fibers based on the total weight of the fiberboard. The amount of fibers in the fiberboard can also range from a low of about 50 wt %, 60 wt %, or 70 wt % to a high of about 85 wt %, 95 wt % or 99 wt %, based on the total weight of the fiberboard.

The fiberboard can include less than 20 wt %, 15 wt %, 10 wt %, 9 wt %, 8 wt %, 7 wt %, 6 wt %, 5 wt %, 4 wt %, 3 wt %, 2 wt %, 1 wt %, 0.5 wt %, 0.3 wt %, or 0.1 wt %, combined weight of resin and wax, based on the total weight of the fiberboard. The amount of combined resin and wax can range from a low of about 0.1 wt %, 0.5 wt %, 1 wt % to a high of about 2 wt %, 3.5 wt %, or 5 wt %, based on the total weight of the fiberboard. Preferably, the fiberboard contains no resin and no wax.

The fiberboard can include less than 5 wt %, 4 wt %, 3 wt %, 2 wt %, 1 wt %, 0.5 wt %, 0.3 wt %, or 0.1 wt % resin, based on the total weight of the fiberboard. The amount of resin can range from a low of about 0.1 wt %, 0.5 wt %, 1 wt % to a high of about 2 wt %, 3.5 wt %, or 5 wt %, based on the total weight of the fiberboard. Preferably, the fiberboard contains no resin.

In one or more embodiments, the fiberboard includes less than 5 wt %, 4 wt %, 3 wt %, 2 wt %, 1 wt %, 0.5 wt %, 0.3 wt %, or 0.1 wt % wax, based on the total weight of the fiberboard. The amount of wax can range from a low of about 0.1 wt %, 0.5 wt %, 1 wt % to a high of about 2 wt %, 3.5 wt %, or 5 wt %, based on the total weight of the fiberboard. Preferably, the fiberboard contains no wax.

In one or more embodiments, the fiberboard can be substantially free of added resins and waxes. The term "substantially free of added resins and waxes," as used herein, refers to a fiber or fiberboard having no added resins and waxes. The only resins and waxes present in the fiber or fiberboard is a negligible amount, such as less than 5 wt % based on the total weight of the fiberboard, contained with any surfactant, fiber, or colorant used to make the fiber or fiberboard. In other words, no resin or wax is intentionally added to the fiber or fiberboard, according to the present invention. Preferably, a fiberboard substantially free of added resins and waxes is a fiberboard that contains less than about 5%, less than about 3%, less than about 2%, less than about 1%, or less than about 0.5% of combined amount of resin and wax, based on the total weight of the fiberboard including any coatings disposed thereon.

The fibers or fibrous materials of the fiberboard can include, but are not limited to, organic based, inorganic based, or combinations thereof. Organic based fibers can include, but are not limited to, lignocellulosic fibers (fibers that comprise both cellulose and lignin); straw; hemp; sisal; cotton stalk; wheat; bamboo; sabai grass; rice straw; banana leaves; paper mulberry (i.e., bast fiber); abaca leaves; pineapple leaves; esparto grass leaves; fibers from the genus Hesperaloe in the family Agavaceae jute; salt water reeds; palm fronds; flax; ground nut shells; hardwoods; softwoods; recycled fiberboards such as high density fiberboard; medium density fiberboard; low density fiberboard; oriented strand board; particle board; animal fibers (e.g., wool, hair); recycled paper products (e.g., newspapers, cardboard, cereal boxes, and magazines); or any combination thereof. In at least one specific embodiment, the fiber material can include wood, for example hardwoods, softwoods, or a combination thereof. Inorganic based fibers can include, but are not limited to plastic fibers (e.g., polypropylene fibers, polyethylene fibers, polyvinyl chloride fibers, polyester fibers, polyamide fibers, polyacrylonitrile fibers); glass fibers; glass wool; mineral fibers; mineral wool; synthetic inorganic fibers (e.g., aramid fibers, carbon fibers); ceramic fibers; and any combination thereof. In one or more embodiments, organic and inorganic based fibers can be combined to provide the fibers in the fiberboard.

Suitable forms of starting fiber materials can be or include chips, shavings, boards, logs, panels, sheets of paper, cardboard, sawdust, or the like. In one or more embodiments, the fibers can be from a chemical pulp obtained from softwood and/or hardwood chips liberated into fiber by sulfate, sulfite, sulfide or other chemical pulping processes. In one or more embodiments, fibers can be obtained from a fiber material by mechanical based methods. For example, a fiber pulp can be obtained by mechanical treatment of softwood and/or hardwood, recycled fiber, and other refined fiber. The starting fiber material can be reduced in size by softening the starting fiber material with steam and pressure and then mechanically grinding the fiber material in a grinder to produce the desired fiber size. The fiber material can be reduced to a length ranging from a low of about 0.05 mm, about 0.1 mm, about 0.2 mm to a high of about 1 mm, about 5 mm, about 10 mm, or about 20 mm.

In one or more embodiments, the fiberboard can include of from about 1 wt % to about 40 wt % surfactant, based on the total weight of the fiberboard. The surfactant also can be present in an amount of from about 1 wt %, 5 wt %, or 10 wt % to a high of about 15 wt %, 25 wt %, or 40 wt %. In one or more embodiments, the surfactant can be present in an amount of from about 3 wt %, 5 wt %, or 7 wt % to a high of about 9 wt %, 15 wt %, or 18 wt %. The amount of surfactant can also range from about 1 wt % to about 25 wt %; about 3 wt % to about 20 wt %; about 5 wt % to about 15 wt %; or about 5 wt % to about 10 wt %.

The surfactant can be non-ionic, cationic, anionic, or amphoteric. In one or more embodiments, the surfactant can be substantially free of polyoxyethylene groups. In one or more embodiments, the surfactant can be or include halogen-capped (e.g., chlorine capped) surfactants, linear alcohol based surfactants, or alkoxylated (e.g., ethoxylated or propoxylated) alcohol surfactants. In at least one specific embodiment, the surfactant can be or include branched alcohol ethyoxylates, for example decyl alcohol ethoxylates having a Hydrophile/Lipophile Balance ("HLB") value ranging from a low of about 7, about 9, or about 11 to a high of about 13, about 14, or about 15. Illustrative and commercially available surfactants can include, but are not limited to the RhodaSurf® DA series of non-ionic surfactants available from Rhodia, which are described as branched isodecyl alcohol ethoxylates. For example, the surfactant can be or include RhodaSurf DA-639, which is a 90% solution of RhodaSurf DA-630, which has been described as having 6 moles of ethoxylation and an HLB of 12.5. Other illustrative and commercially available surfactants can include, but are not limited to, Surfonic® surfactants available from Huntsman, Marlipal® and Alonic surfactants available from Sasol, Desonic surfactants available from Crompton, Trycol® surfactants available from Cognis, Iconol surfactants available from BASF, and Genapol® surfactants available from Clariant.

In one or more embodiments, a coating can be applied to at least one surface of the fiberboard. The coating can include at least one colorant to provide a desirable or visually appeasing fiberboard. The colorant can also provide heat transfer properties across the surface of the fiberboard in which it is applied.

The colorant can include one or more pigments, dyes, or combinations thereof. In one or more embodiments, the colorant can be in any suitable form, for example liquid, powder, granules, or crystals. The colorant can be organic based, synthetic based, inorganic based, or any combination thereof. If a dye, the colorant can be dissolved in a solvent, which can be water, an alcohol, oil, or lacquer. If a pigment, the colorant can be suspended in a liquid, which can be water, oil, alcohol, or lacquer. Illustrative colorants can include, but are not limited to, clay, chalk, barite, silica, talc, bentonite, glass powder, alumina, titanium dioxide, graphite, carbon black, zinc sulfide, alumina silica, calcium carbonate, hollow glass spheres, organic spheres and any combination thereof. Illustrative clays can include, but are not limited to, kaolin clay, engineered clays, delaminated clays, structured clays, calcined clays, and combinations thereof.

The colorant can provide any desirable color. For example, the colorant can be green, brown, blue, read, yellow, white, orange, purple, or pink. An illustrative and commercially available colorant can include Keyazine Malachite Green from Keystone Aniline Corporation.

In one or more embodiments, the fiberboard can include of from about 0.01 wt % to about 10 wt % colorant, based on the total weight of the fiberboard. The colorant also can be present in an amount of from about 0.01 wt %, 0.05 wt %, or 1.0 wt % to a high of about 2.0 wt %, 5 wt %, or 10 wt %. In one or more embodiments, the colorant can be present in an amount of from about 0.3 wt %, 0.5 wt %, or 0.7 wt % to a high of about 1.0 wt %, 1.5 wt %, or 2.5 wt %. The amount of colorant can also range from about 0.01 wt % to about 2.5 wt %; about 0.3 wt % to about 2.0 wt %; about 0.5 wt % to about 1.5 wt %; or about 0.5 wt % to about 1.0 wt %.

In one or more embodiments, the colorant is uniformly dispersed or distributed about the coated surface of the fiberboard. The colorant can cover at least 50% or more of the coated fiberboard surface. In one or more embodiments, the colorant can cover at least 60%, at least 65%, at least 70%, at least 75%, at least 80%, at least 85%, at least 90%, at least 95%, at least 97%, or at least 99% of the coated fiberboard surface. In one or more embodiments, the colorant dispersion can range from a low of about 20%, 30%, or 40% to a high of about 70%, 85%, or 95% of the coated surface of the fiberboard. In one or more embodiments, the colorant can cover about 20% to 90%; 30% to 90%; 50% to 95%; or 55% to 90% of the coated surface of the fiberboard.

In one or more embodiments, the fiberboard can further include one or more other additives. Such additives can be added to the fiber slurry or the coating or both. Illustrative additives can include, but are not limited to, defoamers, antifoamers, dispersants, lubricants, crosslinkers, antislipping agents, thickeners, fire retardants, and insolubilizers.

The fiberboard can be made using any suitable fabrication process. For example the fiberboard can be made using a wet process, a dry process, or a wet/dry process. In an illustrative process for making the fiberboard, the fibers can be mixed with water, to provide a fiber/liquid slurry. The fiber/liquid slurry can contain about 50% or more, about 60% or more, about 70% or more, about 80% or more, about 90% or more, or about 100% or more than 100% water. The fiber/liquid slurry is then deposited onto a liquid-pervious support member, such as a screen or a Fourdrinier wire. The liquid-pervious support member can be stationary or moving. A moving liquid-pervious support member can promote removal of at least a portion of the liquid phase (first portion) and a more level or even distribution of the slurry on the liquid-pervious member as compared to a stationary liquid-pervious support member. Such liquid-pervious support members can remove a low of about 5%, about 10%, about 20%, about 30%, or about 40% to a high of about 50%, about 60%, about 70%, about 80%, or more than about 80% of the total amount of liquid used to form the fiber/liquid slurry. As such, the resulting fiber mat can include about 80% moisture content or less, about 70% moisture content or less, about 60% moisture content or less, about 50% moisture content or less, about 40% moisture content or less, or about 30% moisture content or less. As used herein, the term "moisture content" refers to the amount of water in the fiberboard, based on total weight percent of the fiberboard and water.

The fiber mat can then be pressed in one or more press devices, rollers, or the like to remove additional liquid ("second portion"). For example, the fiber mat can be transferred from the moving screen to a caul plate having a screen attached thereto. The caul plate, screen, and fiber mat can be introduced to a press device. When pressure is applied to the caul plate, screen, and fiber mat, the pressure can force the liquid from the fiber mat and out through the screen, thereby forming the fiberboard. The pressure applied to the fiberboard can be about 350 kPa or more, about 700 kPa or more, about 1500 kPa or more, about 3,000 kPa or more, about 6,000 kPa or more, or about 9,000 kPa or more. For example, the pressure applied to the fiberboard can range from about 3,500 kPa to about 8,500 kPa, or from about 4,500 kPa to about 8,000 kPa, or from about 5,500 kPa to about 7,700 kPa.

The applied pressure removes about 40% or more, about 60% or more, about 70% or more, about 80% or more, or about 90% or more of the remaining liquid from the fiber mat to provide a fiberboard. The resulting fiberboard can have about 10% moisture content or less, about 7% moisture content or less, about 6% moisture content or less, about 5% moisture content or less, about 4% moisture content or less, or about 3% moisture content or less, about 2% moisture content or less, or about 1% moisture content, or less than about 1% moisture content.

The caul plate can be a solid, smooth plate, to provide a smooth first side on the fiberboard, and the screen provides a rough second side on the fiberboard. As such, the resulting fiberboard has a first side that is smooth and second side that is rough when compared to one another.

The fiberboard can be heated to remove a portion of any remaining or excess liquid. The fiberboard can be heated before the fiber mat is pressed, while the fiber mat is pressed, after the fiberboard is pressed, or any combination thereof. The fiberboard can be dried in the press device, a kiln, by exposure to the atmosphere for a period of time, steam, heated air, heating elements, or any other suitable heating method. The fiberboard is preferably heated at a temperature of about 50° C. or more, about 100° C. or more, about 150° C. or more, about 200° C. or more, about 250° C. or more, or about 300° C. or more. For example, the pressed fiberboard can be heated to a temperature of from about 100° C. to about 260° C., about 150° C. to about 240° C., or about 170° C. to about 220° C.

The pressure and/or heat applied to the fiberboard can be maintained for a predetermined period of time. Such duration can range from a low of about 1 minute, about 2 minutes, or about 3 minutes to a high of about 5 minutes, about 7 minutes, or about 10 minutes. For example, the pressure and/or heat can be applied to the fiberboard for about 4 minutes, about 4.5 minutes, about 5 minutes, about 5.5 minutes, or about 6 minutes. In one or more embodiments, the fiberboard can be heated in a kiln for a period of minutes or hours. In one or more embodiments, the fiberboard can be air dried for a period of hours, days, weeks, or months.

In addition to removing at least a portion of any remaining liquid in the fiberboard, heating the fiberboard can also sterilize the fiberboard. In other words, the heat applied to the fiberboard can kill or otherwise neutralize bacteria, fungus, viruses, microbes, or the like that may be on, in, or about the fiberboard.

The density of the resulting fiberboard can range from a low of about 0.50 g/cm$^3$, about 0.65 g/cm$^3$, or about 0.70 g/cm$^3$ to a high of about 0.90 g/cm$^3$, about 1.1 g/cm$^3$, or about 1.4 g/cm$^3$. In one or more embodiments, density of the fiberboard can range form a low of about 0.40 g/cm$^3$, about 0.50 g/cm$^3$, or about 0.60 g/cm$^3$ to a high of about 0.65 g/cm$^3$, about 0.70 g/cm$^3$, or about 0.80 g/cm$^3$.

The fiberboard can have a thickness ranging from a low of about 1.5 mm, about 2 mm, or about 2.5 mm to a high of about 4 mm, about 7 mm, or about 10 mm. For example, the fiberboard can have a thickness ranging from about 1.5 mm to about 6.4 mm; from about 2.3 mm to about 4.7 mm; or from about 3 mm to about 4 mm. The fiberboard can be formed into sheets of fiberboard. The sheets of fiberboard can have a length of about 1.2 m, about 1.8 m, about 2.4 m, about 3 m, or about 3.6 m. The sheets of fiberboard can have a width of about 0.6 m, about 1.2 m, about 1.8 m, about 2.4 m, or about 3 m.

After pressing and drying the fiberboard one or more coatings can be at least partially disposed on one or more sides of the fiberboard. For example, the coating can be disposed on at least a portion of a first side and/or a second side of the fiberboard. The coating can be applied using any suitable process, such as spraying, brushing, rolling, or the like. In one or more embodiments, the coating can include at least one surfactant and colorant. Preferably, the coating includes about 50 wt % to about 95% surfactant, and about 5% to about 50% colorant. The coating can include 50 wt % or more surfactant, 60 wt % or more, 70 wt % or more, 80 wt % or more, 90 wt % or more, or 95 wt % or more. The coating can also include 5 wt % or more colorant, 10 wt % or more, 20 wt % or more, 30 wt % or more, 40 wt % or more, or 45 wt % or more. In one or more embodiments, the coating can include of from about 50 wt % to about 80 wt %, or about 60 wt % to about 75 wt % surfactant, based on total weight of the coating, and of from 5 wt % to 50 wt %, or 10 wt % to 40 wt % colorant, based on total weight of the coating. The coating can further include about 20 wt % or less of other additives, or 15 wt % or less, or 10 wt % or less, or 5 wt % or less, or 45 wt % or less, or 3 wt % or less, or 2 wt % or less, or 1 wt % or less, based on total weight of the coating.

In at least one embodiment, the coating can be applied to the fiberboard while the fiberboard is at an elevated temperature. For example, the coating can be applied shortly after the fiberboard is heated, if the fiberboard is heated. If the fiberboard is allowed to air dry, the fiberboard can be heated prior to applying the coating. The coating can be applied to the fiberboard when the fiberboard is at a temperature of about 30° C. or more, about 50° C. or more, about 75° C. or more, about 100° C. or more, about 125° C. or more, or about 150° C. or more. Applying the coating to the fiberboard, while the fiberboard is at an elevated temperature, can increase the rate of absorbency of the solution into the fiberboard and/or improve the uniformity of the coating.

Not wishing to be bound by theory, the surfactant is believed to increase the absorbency or the rate at which the fiberboard absorbs liquids into the fiberboard, and uniformly distribute the colorant across the fiberboard where applied. A fiberboard that absorbs liquid can be beneficial in certain applications, such as when the fiberboard is used as flooring or bedding for animals. When the fiberboard is used as a flooring or bedding for animals, the fiberboard can maintain structural rigidity while capable of absorbing moisture. The fiberboard can absorb liquid waste, such as water or urine, and after use, whether a few hours, days, weeks, or months, can be discarded and replaced. For example, the fiberboard can be discarded in a composting pile or other convenient method for disposal because the fiberboard is more easily decomposed than a fiberboard with added resins and waxes. Furthermore, a fiberboard that is substantially free of added resins and waxes is not toxic or substantially less toxic to the environment and animals, if used for such purposes.

The fiberboard can be useful for many types of applications including but not limited to sound reducing walls; flooring; roofing; furniture; automobile production; such as door panels; of the like. The fiberboard is also useful for animal bedding, birthing and rearing. For example, one or more fiberboards can be placed on the floor of an animal containment area to absorb liquids, such as water and urine. Once the fiberboard has become too saturated with liquids, damaged, or otherwise has exceed its practical period of use, the fiberboard can be removed and replaced. To discard, the used fiberboard can be recycled via a compost pile, thereby reducing waste disposal in landfills and the costs associated therewith, while at the same time providing a useful product, compost.

Furthermore, the colorant can provide a surface that evenly absorbs heat. Since heat lamps are typically used to provide warmth to new or young animals, such as pigs, chickens, goats, rabbits, sheep, and ducks. The colorant can be used to better distribute heat about the surface of the fiberboard so that hot spots do not develop in the surface of the fiberboard, adjacent the lamps. Preferably, the colorant is lighter than black, as a black fiberboard tends to form hot spots, which can harm the animals or reduce the effective area of the containment because the animals tend to stay away from the heat.

Embodiments of the present invention further relate to any one or more of the following paragraphs:

1. A fiberboard, comprising two or more compressed fibers; less than 10 wt % of resin and wax, based on total weight of the fibers; and a coating comprising at least one colorant, wherein the colorant covers at least 70% of the fiberboard surface.

2. The fiberboard according to paragraph 1, wherein the at least one colorant comprises a dye, a pigment, or a combination thereof.

3. The fiberboard according to paragraphs 1 or 2, wherein the fiberboard further comprises a first side and a second side, and wherein the first side is smoother than the second side.

4. The fiberboard according to any of paragraphs 1 to 3, wherein the fiberboard further comprises a first side and a second side, and wherein the first side and the second side have the same surface roughness.

5. The fiberboard according to any of paragraphs 1 to 4, wherein the fibers are derived from wood.

6. The fiberboard according to any of paragraphs 1 to 5, wherein the colorant is disposed about 80% or more of the surface area.

7. The fiberboard according to any of paragraphs 1 to 6, wherein the colorant is disposed about 90% or more of the surface area.

8. A method for making a fiberboard, comprising mixing a fiber material and water to provide a slurry, wherein the slurry is substantially free of added resin and wax; depositing the slurry onto a first liquid-pervious support member; removing a first portion of the water from the slurry to provide a fiber mat; pressing the fiber mat between a smooth surface and a second liquid-pervious support member to remove a second portion of the water from the fiber mat to provide a fiberboard having a first side and a second side, wherein the first side is smoother than the second side; drying the fiberboard; and applying a coating at least partially about the first side, the second side, or both, wherein the coating comprises a surfactant.

9. The method according to paragraph 8, wherein the fiber material comprises wood fibers.

10. The method according to paragraphs 8 or 9, wherein the pressing and drying steps occur simultaneously within a press.

11. The method according to any of paragraphs 8 to 10, wherein the drying step comprises drying at atmospheric temperature and pressure.

12. The method according to any of paragraphs 8 to 11, wherein the surfactant comprises decyl alcohol ethoxylate.

13. The method according to any of paragraphs 8 to 12, wherein the coating further comprises a dye.

14. The method according to any of paragraphs 8 to 13, wherein the pressed fiberboard contains less than about 5 wt % water.

15. The method according to any of paragraphs 8 to 14, wherein the coating is applied when the fiberboard is at a temperature of about 50° C. or more.

16. The method according to any of paragraphs 8 to 15, wherein the coating further comprises a dye, wherein the surfactant is applied in an amount of from about 0.01 to about 0.03% based on the weight of the fiberboard, and wherein the dye is applied in an amount of from about 0.005 to about 0.015% based on the weight of the fiberboard.

17. A fiberboard, comprising compressed fibers, wherein the fibers are substantially free of added resin and wax; and a coating disposed about at least a portion of the fiberboard, wherein the coating comprises from about 0.01 wt % to about 0.03 wt % decyl alcohol ethoxylate, based on the total weight of the fiberboard and at least one colorant.

18. The fiberboard according to paragraph 17, wherein the at least one colorant comprises a dye, a pigment, or a combination thereof.

19. The fiberboard according to paragraphs 17 or 18, wherein the coating comprises about 0.02 wt % decyl alcohol ethoxylate, based on the total weight of the fiberboard 20. The fiberboard according to any of paragraphs 17 to 19, wherein the fibers contain less than about 3 wt % resin and wax, based on total weight of the fiberboard.

21. A fiberboard, comprising compressed fibers, wherein the fibers are substantially free of added resin and wax; and a coating disposed about at least a portion of the fiberboard, wherein the coating comprises a surfactant and at least one colorant.

22. The fiberboard according to paragraph 21, wherein the surfactant comprises decyl alcohol ethoxylate.

23. The fiberboard according to paragraphs 21 or 22, wherein the surfactant is present in an amount of from about 0.01 wt % to about 0.03%, based on the total weight of the fiberboard, and the colorant is present in an amount of from about 0.005 wt % to about 0.015 wt %, based on the total weight of the fiberboard.

24. The fiberboard according to any of paragraphs 21 to 23, wherein the fiberboard further comprises a first side and a second side, and wherein the first side is smoother than the second side.

25. The fiberboard according to any of paragraphs 21 to 24, wherein the fiberboard further comprises a first side and a second side, and wherein the first side and the second side have the same surface roughness.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A fiberboard, comprising:

two or more compressed fibers;

less than 10 wt % wax, based on the total weight of the fibers; and a coating comprising at least one colorant, at least one surfactant, and an additive, wherein the surfactant is present in an amount of about 50 wt % to about 95 wt %, based on the total weight of the coating, wherein the additive comprises an anti-slipping agent and is present in an amount of about 1 wt % to about 10 wt %, based on the total weight of the coating, wherein the colorant covers at least 70% of the fiberboard surface, and wherein the fiberboard is free of resin.

2. The fiberboard of claim 1, wherein the colorant is present in an amount of about 5 wt % to about 50 wt %, based on the total weight of the coating.

3. The fiberboard of claim 1, wherein the fiberboard further comprises a first side and a second side, and wherein the first side is smoother than the second side.

4. The fiberboard of claim 1, wherein the fiberboard further comprises a first side and a second side, and wherein the first side and the second side have the same surface roughness.

5. The fiberboard of claim 1, wherein the fibers are derived from wood.

6. The fiberboard of claim 1, wherein the fiberboard is free of wax.

7. The fiberboard of claim 1, wherein the colorant is present in an amount of about 10 wt % to about 50 wt %, based on the total weight of the coating, and wherein the coating contains less than 15 wt % of additives other than the colorant and the surfactant.

8. The fiberboard of claim 1, wherein the colorant is present in an amount of about 40 wt % to about 50 wt %, based on the total weight of the coating.

9. The fiberboard of claim 1, wherein the surfactant comprises decyl alcohol ethoxylate.

10. The fiberboard of claim 1, wherein the fiberboard has a thickness of about 2 mm to about 7 mm, and wherein the compressed fibers have a length of about 0.1 mm to about 10 mm.

11. The fiberboard of claim 10, wherein the anti-slipping agent is present in an amount of about 1 wt % to about 5 wt %, based on the total weight of the coating.

12. A fiberboard, comprising:

compressed fibers, wherein the fiberboard is substantially free of added resin and wax; and a coating disposed about at least a portion of the fiberboard, wherein the coating comprises decyl alcohol ethoxylate, at least one colorant, and an additive, wherein the additive comprises an anti-slipping agent and is present in an amount of about 1 wt % to about 10 wt %, based on the total weight of the coating, and wherein the decyl alcohol ethoxylate is present in an amount of about 50 wt % to about 95 wt %, based on the total weight of the coating.

13. The fiberboard of claim 12, wherein the colorant is present in an amount of about 5 wt % to about 50 wt %, based on the total weight of the coating.

14. The fiberboard of claim 12, wherein the coating comprises about 0.02 wt % decyl alcohol ethoxylate, based on the total weight of the fiberboard.

15. The fiberboard of claim 12, wherein the fiberboard is free of resin.

16. The fiberboard of claim 12, wherein the fiberboard has a thickness of about 2 mm to about 7 mm, and wherein the compressed fibers have a length of about 0.1 mm to about 10 mm.

17. The fiberboard of claim 16, wherein the anti-slipping agent is present in an amount of about 1 wt % to about 5 wt %, based on the total weight of the coating.

18. A fiberboard, comprising:

compressed fibers, wherein the fiberboard is substantially free of added resin and wax; and a coating disposed about at least a portion of the fiberboard, wherein the coating comprises at least one surfactant, at least one colorant, and an additive, wherein the surfactant is present in an amount of about 50 wt % to about 95 wt %, based on the total weight of the coating, wherein the surfactant comprises decyl alcohol ethoxylate, and wherein the additive comprises an anti-slipping agent and is present in an amount of about 1 wt % to about 10 wt %, based on the total weight of the coating.

19. The fiberboard of claim 18, wherein the surfactant is present in an amount of from about 0.01 wt % to about 0.03 wt %, based on the total weight of the fiberboard.

20. The fiberboard of claim 18, wherein the fiberboard has a thickness of about 2 mm to about 7 mm, and wherein the compressed fibers have a length of about 0.1 mm to about 10 mm.

21. The fiberboard of claim 20, wherein the anti-slipping agent is present in an amount of about 1 wt % to about 5 wt %, based on the total weight of the coating.

22. A fiberboard, comprising:

two or more compressed fibers, wherein the fiberboard is free of wax;

less than 1 wt % resin, based on the total weight of the fibers; and a coating disposed on a first side of the fiberboard, wherein the coating comprises at least one colorant, at least one surfactant, and an additive, wherein the surfactant is present in an amount of about 50 wt % to about 95 wt %, based on the total weight of the coating, and wherein the additive comprises an anti-slipping agent and is present in an amount of about 1 wt % to about 10 wt %, based on the total weight of the coating.

23. The fiberboard of claim 22, wherein the fiberboard is free of resin.

24. The fiberboard of claim 22, wherein the surfactant is present in an amount of about 60 wt % to about 95 wt %, based on the total weight of the coating, and wherein the colorant is present in an amount of about 30 wt % or more, based on the total weight of the coating.

25. The fiberboard of claim 22, wherein the coating contains less than 15 wt % of additives other than the colorant and the surfactant.

26. The fiberboard of claim 22, wherein the surfactant is present in an amount of about 60 wt % to about 95 wt %, based on the total weight of the coating, wherein the colorant is present in an amount of about 30 wt % or more, based on the total weight of the coating, and wherein the fiberboard has a density from about 0.4 g/cm$^3$ to about 0.8 g/cm$^3$.

27. The fiberboard of claim 26, wherein the surfactant comprises decyl alcohol ethoxylate, and wherein the fiberboard is free of resin.

28. The fiberboard of claim 22, wherein the fiberboard has a thickness of about 2 mm to about 7 mm, and wherein the compressed fibers have a length of about 0.1 mm to about 10 mm.

29. The fiberboard of claim 28, wherein the anti-slipping agent is present in an amount of about 1 wt % to about 5 wt %, based on the total weight of the coating.

* * * * *